US007696692B2

(12) United States Patent
Kim et al.

(10) Patent No.: US 7,696,692 B2
(45) Date of Patent: Apr. 13, 2010

(54) PLASMA DISPLAY PANEL HAVING AN ELECTRODE STRUCTURE INCLUDING BLACKENED DIELECTRIC LAYER AND METHOD OF FABRICATING SAME

(75) Inventors: Yeong Seok Kim, Gyeonggi-Do (KR); Kuninori Okamoto, Gyeonggi-Do (KR); Jae Joon Shim, Gyeonggi-Do (KR)

(73) Assignee: Cheil Industries, Inc., Gyeongsangbuk-Do (KR)

( * ) Notice: Subject to any disclaimer, the term of this patent is extended or adjusted under 35 U.S.C. 154(b) by 851 days.

(21) Appl. No.: 11/148,927

(22) Filed: Jun. 9, 2005

(65) Prior Publication Data

US 2006/0220556 A1 Oct. 5, 2006

(30) Foreign Application Priority Data

Mar. 29, 2005 (KR) ..... 10-2005-0025864

(51) Int. Cl.
*H01J 17/49* (2006.01)
*H01J 9/02* (2006.01)

(52) U.S. Cl. ..... 313/586; 313/582; 313/584; 313/587; 445/24; 445/49

(58) Field of Classification Search ..... 313/582–587
See application file for complete search history.

(56) References Cited

U.S. PATENT DOCUMENTS

| | | | | |
|---|---|---|---|---|
| 5,880,799 | A * | 3/1999 | Inoue et al. | 349/110 |
| 5,952,782 | A * | 9/1999 | Nanto et al. | 313/584 |
| 6,075,319 | A * | 6/2000 | Kanda et al. | 313/584 |
| 6,650,051 | B1 * | 11/2003 | Park et al. | 313/582 |
| 6,660,324 | B2 * | 12/2003 | O'Rourke et al. | 427/64 |
| 7,378,793 | B2 * | 5/2008 | Kang | 313/582 |
| 2001/0017520 | A1 * | 8/2001 | Masuda et al. | 313/586 |
| 2004/0259452 | A1 * | 12/2004 | Matsumoto et al. | 445/24 |
| 2005/0073255 | A1 * | 4/2005 | Kim et al. | 313/587 |
| 2007/0046568 | A1 * | 3/2007 | Shim et al. | 345/41 |

FOREIGN PATENT DOCUMENTS

| | | |
|---|---|---|
| EP | 1674531 A1 * | 6/2006 |
| JP | 09-055167 | 2/1997 |
| JP | 10-255670 | 9/1998 |
| JP | 2002-025451 | 1/2002 |
| JP | 2002-056774 | 2/2002 |
| JP | 2002-220551 | 8/2002 |

* cited by examiner

*Primary Examiner*—Sikha Roy
(74) *Attorney, Agent, or Firm*—Saliwanchik, Lloyd & Saliwanchik

(57) ABSTRACT

Disclosed herein is a plasma display panel and a method of fabricating the same. The plasma display panel comprises a front glass substrate and a rear glass substrate. An electrode structure disposed between the front and rear glass substrates is prepared in such a way that a non-photosensitive black dielectric layer and a non-photosensitive or photosensitive electrode layer, formed on the front glass substrate, are subjected to heat treatment. The black dielectric layer is blackened at a lower surface by the heat treatment. Current flows between an upper electrode and a transparent electrode and it is possible to assure sufficiently low visibility even though costly metal particles are not used as conductive material on the front substrate of the plasma display panel. It is possible to use various types of black pigments thanks to non-photosensitivity, thus it is possible to fabricate a low-priced plasma display panel due to a reduced material cost.

5 Claims, 1 Drawing Sheet

PLASMA DISPLAY PANEL HAVING AN ELECTRODE STRUCTURE INCLUDING BLACKENED DIELECTRIC LAYER AND METHOD OF FABRICATING SAME

BACKGROUND OF THE INVENTION

1. Field of the Invention

The present invention relates, in general, to a plasma display panel and a method of fabricating the same and, more particularly, to a plasma display panel in which an electrode layer is formed on a non-photosensitive black insulating layer and electrode materials capable of being integrated by being simultaneously sintered are employed.

2. Description of the Related Art

A plasma display panel (PDP) is one of the flat panel displays and a display which competes with LCDs or projection TVs and recently has rapidly increased its market share.

For example, an AC-type PDP comprises a glass substrate in which a transparent electrode (holding electrode) and a bus electrode are covered with a dielectric layer and which is called a front substrate, and another glass substrate which has a cell structure comprised of an address electrode, a dielectric layer, a partition, and fluorescent material and which is called a rear substrate. The substrates are disposed to face each other so that their electrodes are crossed each other.

Voltage is applied between the electrodes of both substrates to cause electric discharge in a cell, and ultraviolet rays generated at this time excite the fluorescent material in the cell, thereby realizing light emission. Due to the structure of the panel, an image which is formed by combining luminous red, green, and blue (RGB) cells is visible from behind a surface of the front substrate, on which the electrodes are formed. Therefore, in order to improve the quality of the image, a method of forming a black electrode between the transparent electrode and the bus electrode has been suggested as a method of avoiding visibility of a rear surface of the bus electrode of the front substrate, which corresponds to a display surface.

A method of forming a black electrode layer using a black pigment which consists mostly of conductive metal and metal oxides, or another method in which a black electrode layer and a white electrode layer are sequentially formed and sintered at a high temperature on a glass substrate so as to reduce visibility of the electrode through a rear surface have been extensively known in the fabrication of the plasma display. However, these are problematic in that, since precious metal, such as Ag, or metal oxides, such as $RuO_2$, are used in the black electrode layer, the material cost is high.

With respect to a method of forming the black electrode, Japanese Patent Laid-Open publication No. Hei. 10-255670 uses ruthenium oxide, Japanese Patent Laid-Open Publication No. 9-55167, and Japanese Patent Publication Nos. 2002-25451 and 2002-56774 employ metal powder and a black pigment as conductive particles. However, all of the above-mentioned technologies use costly metal powder as conductive material so as to enable a black layer to function as an electrode.

Use of a photosensitive black layer material employing only metal oxide has been studied to overcome the above problems. However, this is problematic in that very limited types of metal oxides are applied to the black pigment because of a significant gradual change in viscosity due to reaction with photosensitive organics.

Japanese Patent Publication No. 2002-220551 discloses a photosensitive black composition containing no conductive material. However, this has a limit in that a black pigment to be used must be subjected to surface treatment because of a significant increase in viscosity of the composition due to reaction with components of the photosensitive composition.

SUMMARY OF THE INVENTION

Accordingly, the present invention has been made keeping in mind the above problems occurring in the prior art, and an object of the present invention is to provide a low-priced plasma display panel in which current can flow between upper (adjacent to the rear glass substrate 35 and comprising the electrode layer 34) and transparent electrodes and to which various types of black pigments are applied even though costly metal particles are not used, and a method of fabricating the same.

In order to accomplish the above object, the present invention provides a plasma display panel. The plasma display panel comprises a front glass substrate 31 and a rear glass substrate 35. An electrode structure disposed between the front and rear glass substrates is prepared in such a way that a non-photosensitive black dielectric layer 33 and a non-photosensitive or photosensitive electrode layer 34, formed on the front glass substrate 31, are subjected to heat treatment. The black dielectric layer 33 is blackened at a lower surface by the heat treatment.

The present invention aims to assure sufficiently low electrode visibility through a rear glass substrate using blackening and to assure electric conduction between an upper electrode (adjacent to the rear glass substrate 35 and comprising the electrode layer 34) and a transparent electrode 32, thereby gaining economic efficiency in terms of material. In other words, the present invention aims to fabricate, at low cost, a panel which is used as the front substrate of a plasma display panel and through which an electrode is difficult to see.

The other objects, advantages, and novel features of the present invention will be more clearly understood from the following detailed description and preferred embodiments.

DESCRIPTION OF THE PREFERRED EMBODIMENTS

Figure 1:
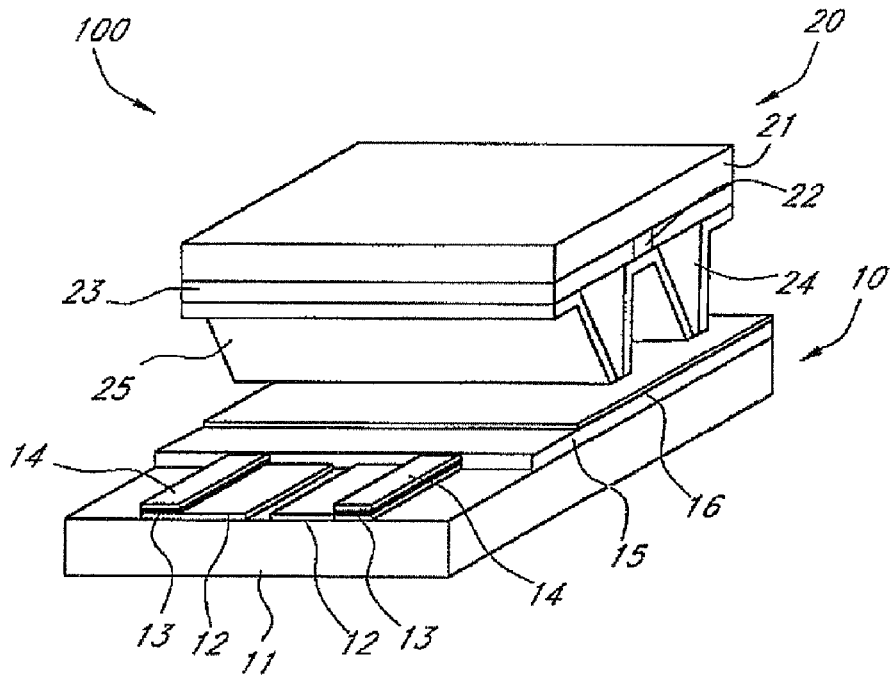
FIG. 1 (Prior Art)
FIG. 1 (prior art) illustrates a perspective view of a conventional plasma display panel (PDP) 100. The plasma display panel 100 includes a front panel 10 and a rear panel 20. The front panel 10 includes a front substrate 11, transparent electrodes 12, black electrode layers 13, and bus electrode layers 13, a dielectric layer 15, and a protection film 16. The real panel 20 includes a rear substrate 21, an address electrode 22, a dielectric layer 23, barrier ribs 24, and a fluorescent layer 25. A skilled artisan would appreciate that details of the plasma display panel structure may be varied depending on its design.
Figure 2:
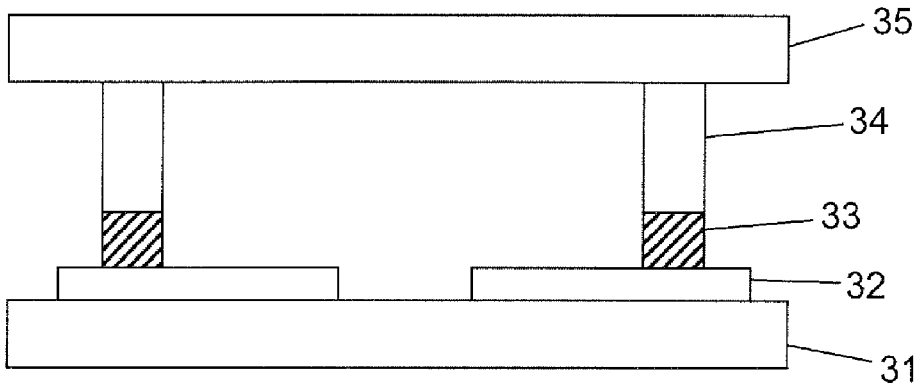
FIG. 2 illustrates an embodiment of a plasma display panel forming a non-photosensitive black dielectric layer and a non-photosensitive or photosensitive electrode layer on the front glass. The front glass 31, transparent electrodes 32,. a non-photosensitive black dielectric layer 33, a non-photosensitive or photosensitive electrode layer 34.

Hereinafter, a description will be given of a plasma display panel and a method of fabricating the same according to the present invention.

According to the present invention, PDP electrode material is used to form an electrode provided on the front substrate of the plasma display panel, and it is possible to freely select a pigment because a black insulating composition is non-photosensitive. Furthermore, the non-photosensitive black insulating composition having no conductivity and a photosensitive electrode composition are layered, patterned through a photolithography process, and subjected to heat treatment, such as sintering, to function together as an electrode.

In the present invention, after a black insulating composition of a black dielectric layer 33 and an electrode composition of an electrode layer 34 are made into a paste, the paste may be patterned using a screen printing method or an offset printing method, or may be patterned using a photolithography process after printed a not patterned square area.

Furthermore, after the black dielectric layer 33 and the electrode layer 34 are formed on the front glass substrate 31, a pattern may be formed on the glass substrate using a transcription method, thereby creating a two-layered film structure thereon, or, after the black dielectric layer and the electrode layer are formed and transcribed on the front glass substrate (F*igure* 1), a pattern may be formed using the photolithography process.

In the present invention, instead of the black electrode layer, the black insulating layer containing no costly conductive material consists of non-photosensitive material. Thus, it is possible to conduct electrode patterning through the photolithography process using simultaneous development with the photosensitive upper electrode layer, and it is also possible to assure desired performance of an integrated electrode and low visibility of the electrode through a rear substrate, and to reduce the cost using simultaneous sintering. In other words, in the present invention, since the type of black pigment is not limited, it is possible to realize a design using low-priced material.

In the present invention, an organic binder component which is not photosensitive but is capable of being dissolved in a developing solution and an appropriate plasticizer are combined with each other to form the photosensitive electrode layer 34 on an upper side of the black layer, or, after the upper electrode layer is formed so as not to have photosensitivity, a photosensitive photoresist layer is formed on the uppermost part, thereby making the patterning using the photolithography process possible.

Accordingly, even though a copper-iron or copper-chromium black complex oxide pigment which has been conventionally considered to increase the viscosity of the composition is employed, reduction of stability of the composition, such as a change in viscosity, does not occur and it is possible to use low cost material.

Furthermore, the inventors of the present invention have used an insulating layer, resulting in the finding that a conductivity generation mechanism of a transparent electrode 32 and an upper electrode is based on interdiffusion between them during a sintering process, and that, if the sintering process is conducted at about 560° C. which is one of the fabrication conditions of the front substrate of the PDP, various types of black pigments can be used without conductive particles.

Therefore, the method of forming the bus electrode of the PDP front substrate using the non-photosensitive black insulating composition according to the present invention is advantageous in that the visibility of the electrode through the rear glass substrate 35 is reduced and it is unnecessary to use costly conductive powder.

Transition metal oxide particles having no conductivity, or particles which have very high intrinsic resistance as a conductor, such. as borides, nitrides, and carbides of transition metal, are used to form the non-photosensitive black insulating composition according to the present invention. It is preferable that the diameter of each particle of the black insulating composition be 0.1-5 μm. When the diameter of the particle is less than 0.1 μm, reactivity of the particle is very high, thus problems occur such as blistering. When the diameter is more than 5 μm, the density of the black layer is low, causing problems such as reduction of low visibility of the electrode.

Any substance which is capable of being dissolved in a predetermined developing solution may be used as an organic binder. In the case in which an alkaline aqueous solution (for example, 0.4% $Na_2CO_3$ aqueous solution) is used as the developing solution, a resin having a carboxyl group, in detail, both a carboxyl group-containing resin having an ethylene unsaturated double bond and another carboxyl group-containing resin having no ethylene unsaturated double bond, can be used. A weight average molecular weight is 1,000-300,000, and preferably, 5,000-100,000. It is preferable that an acid value be 20-250 mgKOH/g.

Examples of the organic binder may include a copolymer of a carboxyl group-containing monomer, such as acrylic acid, methacrylic acid, or itaconic acid, and a monomer having the ethylene unsaturated double bond, such as acrylic acid ester (acrylic acid methyl, methacrylic acid ethyl, or the like), styrene, acrylic amide, or acrylonitrile, cellulose and an aqueous cellulose derivative. The organic binder may be used alone or in combination.

The plasticizer is used to control the solubility of the organic binder which is capable of being dissolved in a predetermined developing solution. Representative examples include phthalic acid ester, adipic acid ester, phosphoric acid ester, trimellitic acid ester, citric acid ester, epoxy, and polyester.

Furthermore, low molecular weight substances (monomers, oligomers, trimers, or the like) of an acrylic compound used as the photosensitive monomer may be used as the plasticizer.

Other than the above-mentioned components, a solvent, a dispersing agent, a viscosity stabilizing agent, a defoaming agent, or a coupling agent may be added to properly control viscosity.

A glass frit has a softening point of 300-600° C., includes lead oxide, bismuth oxide, or zinc oxide as a main component, and preferably has a glass transition point of 200-500° C. With respect to a particle size, it is preferable that a maximal particle size be not more than 5 μm in consideration of film thickness.

To evaluate the non-photosensitive black insulating composition produced using the above-mentioned components, 65 wt % spherical silver powder having an average particle size of 1.5 μm, 3 wt % glass frit having a softening point of 400° C. and an average particle size of 1.5 μm, and a methylmethacrylate copolymer are combined with an organic binder component, a photosensitive monomer, a photopolymerization initiator, and a photosensitive silver electrode composition containing polymerization preparations.

A better understanding of a non-photosensitive black insulating composition according to the present invention may be obtained through the following examples and comparative examples which are set forth to illustrate, but are not to be construed as the limit of the present invention.

EXAMPLE 1

31.1 wt % Texanol solution containing 40 wt % methacrylic acid-methyl methacrylate copolymer, 6.09 wt % TMPTA as a plasticizer, 0.84 wt % viscosity stabilizing agent, 16.6 wt % cobalt oxide, and 39.4 wt % glass frit were mixed with each other, agitated, kneaded and dispersed using a ceramic 3-roll mill to produce a composition. A solvent was added thereto so as to control viscosity.

EXAMPLE 2

24.6 wt % Texanol solution containing 40 wt % methacrylic acid-methyl methacrylate copolymer, 7.56 wt % titanium oxide powder, 7.29 wt % TMPTA as a plasticizer, 1.0 wt % viscosity stabilizing agent, 10.4 wt % cobalt oxide, and 42 wt % glass frit were mixed with each other, agitated, kneaded and dispersed using a ceramic 3-roll mill to produce a composition. A solvent was added thereto to control viscosity.

EXAMPLE 3

24.6 wt % Texanol solution containing 40 wt % methacrylic acid-methyl methacrylate copolymer, 7.56 wt % titanium oxide powder, 7.29 wt % TMPTA as a plasticizer, 1.0 wt % viscosity stabilizing agent, 10.4 wt % copper oxide-chromium black pigment, and 42 wt % glass frit were mixed with each other, agitated, kneaded and dispersed using a ceramic 3-roll mill to produce a composition. A solvent was added thereto to control viscosity.

COMPARATIVE EXAMPLE 1

24.6 wt % Texanol solution containing 40 wt % methacrylic acid-methyl methacrylate copolymer, 7.56 wt % titanium oxide powder, 7.29 wt % TMPTA as a plasticizer, 1.0 wt % viscosity stabilizing agent, 10.4 wt % cobalt oxide, 42 wt % glass frit, 2.4 wt % ITX, and 2.4 wt % EDAB were mixed with each other, agitated, kneaded and dispersed using a ceramic 3-roll mill to produce a composition. A solvent was added thereto to control viscosity.

To evaluate them, the compositions of examples 1 to 3 were applied using a screen printing method on a high melting point glass substrate having a size of 10 cm×10 cm, on which a transparent electrode (ITO) was formed, and dried at 90° C. for 10 min in an IR belt drier. Photosensitive silver electrode material was applied thereon using a screen printing method, and was then dried. The resulting two-layered structure was exposed using a photomask which was designed to have a line space of 120 μm and an exposing device employing a high pressure mercury UV lamp at intensity of 400 mJ/cm$^2$. After the exposure, a pattern was formed using 0.4 wt % $Na_2CO_3$ aqueous solution at 30° C. through a photolithography process. As a result, it was confirmed that, even though the black insulating compositions of the examples were not photosensitive, a desired straight line was formed.

After a sample having the pattern formed thereon was sintered at 560° C. for 20 min using a belt sintering furnace, it was confirmed that, even though an upper silver electrode and a lowermost transparent electrode layer were separated from each other by a black insulating layer, current flowed therebetween. Blackness of a rear surface of the glass substrate was measured using a chromoscope manufactured by Minolta, Inc., resulting in confirmation that a value of L* was 13. Thereby, it was confirmed that it was possible to realize sufficient blackness.

With respect to an increase in viscosity due to the photosensitive composition, example 2 was compared to comparative example 1. In the comparative example, the viscosity was significantly increased, thus causing solidification after two days. However, in the example, a significant increase in the viscosity did not occur even after it was left at room temperature for one month.

Even though the composition of example 3 included a copper-chromium black pigment which is considered to cause an increase in viscosity of photosensitive compositions, a significant change in viscosity did not occur even after it was left at room temperature for one month.

As described above, a plasma display panel and a method of fabricating the same according to the present invention are characterized in that, on a front substrate of the plasma display panel produced using a non-photosensitive black insulating composition, current flows between an upper electrode and a transparent electrode and it is possible to assure sufficiently low visibility even though costly metal particles are not used as conductive material. Furthermore, it is possible to use various types of black pigments because of non-photosensitivity, thus it is possible to fabricate a low-priced plasma display panel at reduced material cost.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A plasma display panel, comprising:

a front glass substrate;

a rear glass substrate; and an electrode structure disposed between the front and rear glass substrates, wherein the electrode structure is formed by laminating a non-photosensitive black dielectric layer and a non-photosensitive electrode layer on the front glass substrate, wherein the non-photosensitive black dielectric layer includes one or more black pigments selected from a group consisting of oxides, borides, carbides and nitrides of transition metals having no conductivity, and wherein the electrode structure is configured, by heat treatment, to apply an electric current between the non-photosensitive black dielectric layer and the non-photosensitive electrode layer.

2. The plasma display panel as set forth in claim 1, wherein the surface is black so that an L* value is 1-40.

3. The plasma display panel as set forth in claim 1, wherein a thickness of the black dielectric layer is 0.5-5 μm when the black dielectric layer consisting of a single layer is sintered.

4. The plasma display panel as set forth in claim 1, wherein the heat treatment comprises performing a sintering process at a temperature of about 560° C.

5. The plasma display panel as set forth in claim 4, wherein the sintering process is performed for 20 minutes.

* * * * *

UNITED STATES PATENT AND TRADEMARK OFFICE

CERTIFICATE OF CORRECTION

PATENT NO. : 7,696,692 B2
APPLICATION NO. : 11/148927
DATED : April 13, 2010
INVENTOR(S) : Yeong Seok Kim et al.

It is certified that error appears in the above-identified patent and that said Letters Patent is hereby corrected as shown below:

Column 2
Lines 45-46 "bus electrode layers 13," should read --bus electrode layers 14,--
Line 55 "electrodes 32,." should read --electrodes 32,--

Signed and Sealed this

First Day of June, 2010

David J. Kappos

David J. Kappos
*Director of the United States Patent and Trademark Office*